US005393206A

United States Patent [19]

Roth et al.

[11] Patent Number: 5,393,206

[45] Date of Patent: Feb. 28, 1995

[54] FUEL PUMP FOR A MOTOR VEHICLE

[75] Inventors: Robert A. Roth, Grand Blanc; John G. Fischer, Goodrich, both of Mich.

[73] Assignee: General Motors Corporation, Detroit, Mich.

[21] Appl. No.: 265,252

[22] Filed: Jun. 29, 1994

[51] Int. Cl.[6] ..... F04B 39/00

[52] U.S. Cl. ..... 417/313; 417/203; 417/423.12; 418/260

[58] Field of Search ..... 417/203, 423.12, 313; 418/259, 260

[56] References Cited

U.S. PATENT DOCUMENTS

| | | | |
|---|---|---|---|
| 4,445,820 | 5/1984 | Hayashi et al. | 417/366 |
| 4,449,891 | 5/1984 | Kemmner | 417/423 R |
| 4,672,937 | 6/1987 | Fales et al. | 123/509 |
| 4,801,252 | 10/1989 | Wrobel | 417/423.12 |
| 5,013,222 | 5/1991 | Sokol et al. | 417/366 |
| 5,173,037 | 12/1992 | Martin et al. | 417/423.3 |

*Primary Examiner*—Richard A. Bertsch
*Assistant Examiner*—William J. Wicker
*Attorney, Agent, or Firm*—Saul Schwartz

[57] ABSTRACT

A motor vehicle fuel pump including a tubular steel housing and a roller vane positive displacement pump and an electric motor in the tubular steel housing. The roller vane pump includes a pair of flat side plates, a rotor between the side plates, and a T-shaped sleeve bearing in a plain bore in one of the side plates. A lip at one end of a tubular body of the sleeve bearing has a side defining an annular seat in a plane perpendicular to the tubular body. The tubular body has a shaft bore therethrough and a stepped outer wall including a large diameter part adjacent the annular seat and a small diameter part adjacent the large diameter part. The large diameter part is force fitted in the plain bore until the annular seat engages flush against a flat, outside surface of the side plate. The annular seat positions the longitudinal centerline of the tubular body perpendicular to the outer side plate for optimum alignment with the armature shaft when an end of the latter is disposed in the shaft bore. The pump rotor is rotatably supported on the small diameter part of the sleeve bearing which protrudes beyond the outer side plate.

3 Claims, 4 Drawing Sheets

FUEL PUMP FOR A MOTOR VEHICLE

FIELD OF THE INVENTION

This invention relates to a motor vehicle fuel pump.

BACKGROUND OF THE INVENTION

A commercially available motor vehicle fuel pump manufactured by the assignee of this invention, General Motors Corporation, includes a roller vane positive displacement pump and an electric motor. A sleeve bearing on a side plate of the roller vane pump rotatably supports one end of an armature shaft of the motor on the side plate. A rotor of the roller vane pump is mounted on the armature shaft. When the motor is on, the armature shaft may tip the sleeve bearing relative to the side plate due to fluid pressure induced side thrust on the rotor. A motor vehicle fuel pump according to this invention is an improvement relative to the aforesaid commercially available motor vehicle fuel pump.

SUMMARY OF THE INVENTION

This invention is a new and improved motor vehicle fuel pump including a tubular steel housing and a roller vane positive displacement pump and an electric motor in the tubular steel housing. The roller vane pump includes a first or inner side plate nearest to the electric motor, a second or outer side plate furthest from the electric motor, a rotor between the side plates, and a T-shaped sleeve bearing in a plain bore in the outer side plate. A lip at one end of a tubular body of the sleeve bearing has a side defining an annular seat in a plane perpendicular to the tubular body. The tubular body has a shaft bore therethrough and a stepped outer wall including a large diameter part adjacent the annular seat and a small diameter part adjacent the large diameter part. The large diameter part of the outer wall of the sleeve bearing is force fitted in the plain bore until the annular seat engages flush against a flat, outside surface of the outer side plate. The annular seat positions the tubular body perpendicular to the outer side plate for optimum alignment with the armature shaft when a pump end of the latter is disposed in the shaft bore. The large diameter part of the outer wall spans the thickness of the outer side plate of the pump for maximum resistance to tipping of the sleeve bearing in the plain bore. The pump rotor is rotatably supported on the small diameter part of the outer wall of the sleeve bearing which protrudes beyond the outer side plate.

DESCRIPTION OF A PRIOR MOTOR VEHICLE FUEL PUMP

Figure 1:
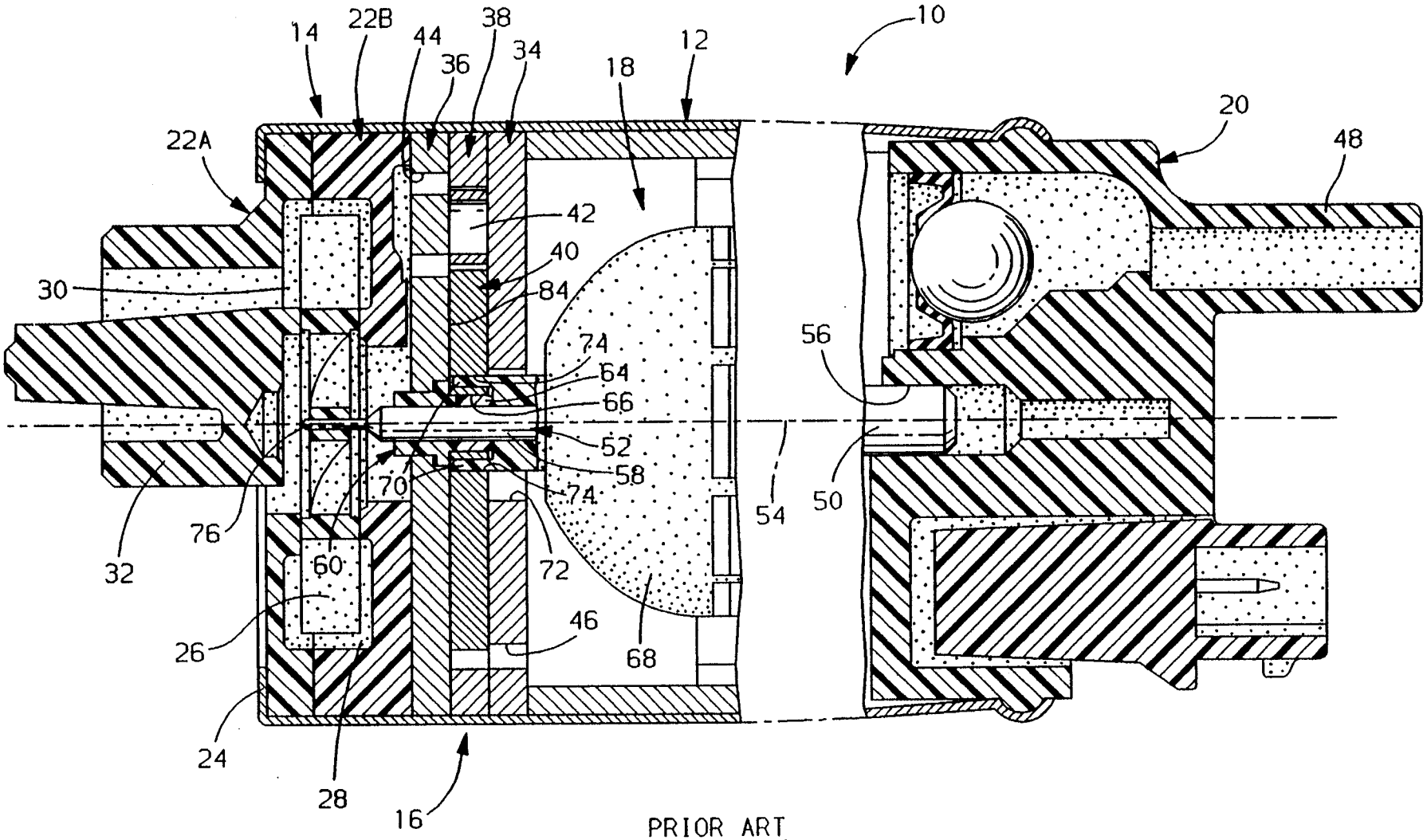
PRIOR ART FIG. 1
FIG. 1 is a fragmentary, sectional view taken along the longitudinal centerplane of a prior motor vehicle fuel pump.
Figure 2:
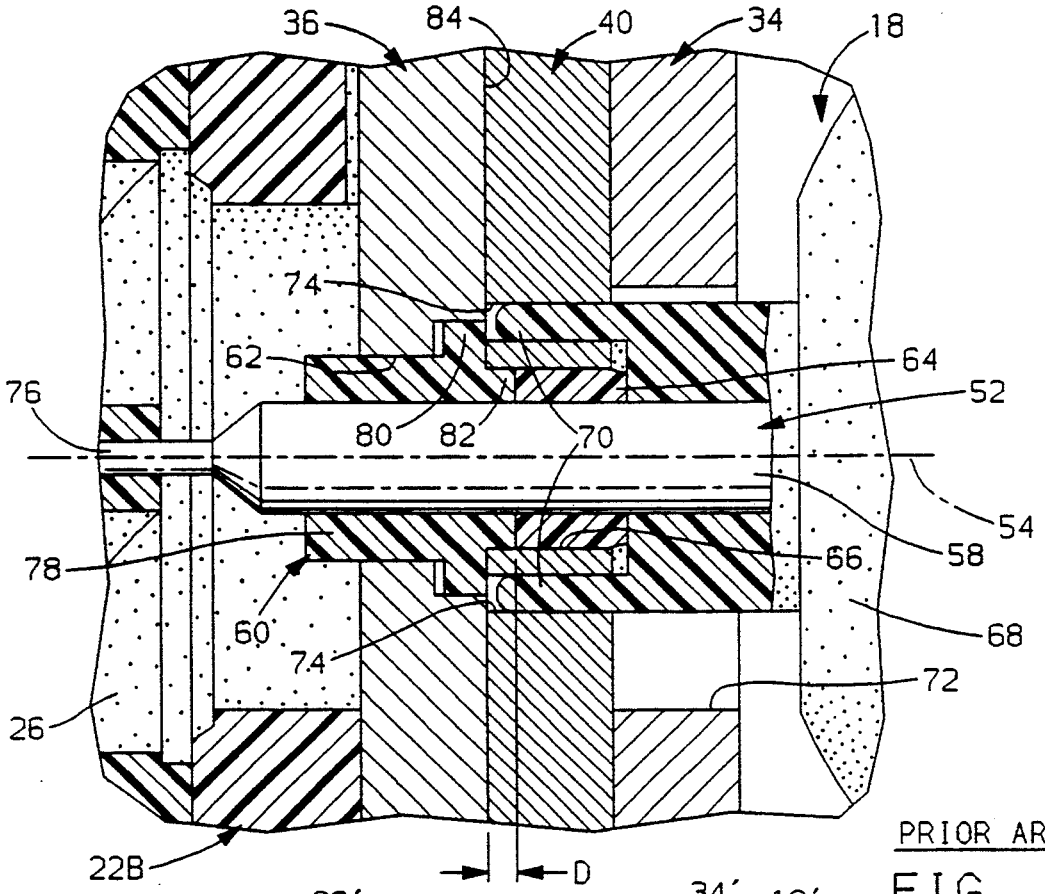
PRIOR ART FIG. 2
FIG. 2 is an enlarged view of a portion of FIG. 1.

Referring to FIGS. 1–2, a motor vehicle fuel pump 10, representative of the aforesaid commercially available motor vehicle fuel pump and usually mounted inside a motor vehicle fuel tank, not shown, includes a tubular steel housing 12, a vapor separating turbine pump 14, a roller vane positive displacement pump 16, an electric motor 18, and an end housing 20 on the other side of the motor from the pumps 14, 16. The turbine pump 14 includes a pair of plastic housings 22A–B closely received in the steel housing 12 against a lip 24 thereof and an impeller 26 in a pump chamber 28 defined between the plastic housings. An inlet 30 to the pump chamber 28 is defined inside a cylindrical boss 32 on the plastic housing 22A. A discharge, not shown, from the pump chamber 28 is defined in the plastic housing 22B. A representative vapor separating turbine pump is described in U.S. Pat. No. 4, 718, 827, issued Jan. 12, 1988 and assigned the assignee of this invention.

The roller vane pump 16 includes a flat, disc-shaped first or inner steel side plate 34 closely received in the steel housing 12 nearest the motor 18; a flat, disc-shaped second or outer steel side plate 36 closely received in the steel housing 12 furthest from the motor 18; a cam ring 38 between the side plates 34, 36; a rotor 40 inside the cam ring; and a plurality of rollers 42 in pockets in the rotor. An inlet port 44 of the roller vane pump in the outer side plate 36 communicates with the discharge of the turbine pump 14. Fuel is discharged into the center of the housing 12 around the motor 18 through a discharge port 46 of the roller vane pump in the inner side plate 34. High pressure fuel is discharged from the housing 12 through a tubular boss 48 on the end housing 20.

A cylindrical commutator end 50 of an armature shaft 52 of the electric motor is supported for rotation about a centerline 54 of the tubular steel housing 12 in a journal defined by a bore 56 in the end housing 20. A cylindrical pump end 58 of the armature shaft is supported for rotation about the centerline 54 by a sleeve bearing 60 in a stepped bore 62 in the outer side plate 36. The rotor 40 is mounted on the pump end 58 of the armature shaft 52 adjacent the sleeve bearing by a spacer 64 on the shaft inside a bore 66 in the rotor.

A plastic driver 68 molded on the armature shaft 52 has a pair of lugs 70 protruding through an access opening 72 in the inner side plate 34 into corresponding ones of a pair of oversize sockets 74 in the rotor 40. The pump end of the armature shaft is flattened to define a drive tang 76 which engages a correspondingly shaped bore in the impeller 26 of the turbine pump. When the motor 18 is on, the lugs 70 and the tang 76 rotate, respectively, the rotor 40 and the impeller 26 as a unit with the armature shaft.

The sleeve bearing 60 is made of thermo plastic, for example lubricomp or polyphenylene sulfide with 15% polytetra fluoroethylene and 30% carbon fiber, and includes a tubular body 78, an annular lip 80 on the tubular body, and an annular pilot boss 82. The stepped bore 62 has a shallow counterbore in an inside surface 84 of the outer side plate 36 in which the lip 80 nests when the sleeve bearing is force fitted in the stepped bore. When the roller vane pump is assembled, the annular pilot boss maintains the bore 66 in the rotor 40 concentric with the centerline 54 until the pump end 58 of the armature shaft is installed in the bore in the tubular body of the sleeve bearing but does not afford the rotor any bearing support on the outer side plate 36. The shallow counterbore blocks the lip 80 to prevent armature shaft thrust toward the pumps 14, 16 from dislodging the sleeve bearing from the stepped bore.

In the roller vane pump 16, a dimension "D", FIG. 2, by which the pilot boss 82 projects beyond the plane of the inside surface 84 of the outer side plate 36 is required to be maintained within a tolerance range more narrow than consistently achievable by simply seating the lip 80 of the sleeve bearing against the bottom of the shallow counterbore of the stepped bore 62. Instead, the position of the sleeve bearing is indirectly monitored as the bearing is force fitted in the stepped bore and the dimension "D" is thereafter checked to assure conformity. The absence of broad contact between the lip 80 and the bottom of the shallow counterbore of the stepped bore 62 renders the sleeve bearing 60 susceptible to tipping in the stepped bore relative to the centerline 54 under the influence of fluid pressure induced side thrust of the rotor 40 on the pump end 58 of the armature shaft. Such tipping may contribute to armature shaft vibration.

DESCRIPTION OF A PREFERRED EMBODIMENT

A motor vehicle fuel pump 86 according to this invention is illustrated in FIGS. 3–6. Elements common to both the above described fuel pump 10 and the fuel pump 86 according to this invention and, except as described below, structurally the same, are identified by primed reference characters in FIGS. 3–6. The fuel pump 86 includes a tubular steel housing 12', a vapor separating turbine pump 14', a roller vane positive displacement pump 16', an electric motor 18', and an end housing 20'. The turbine pump 14' includes a pair of plastic housings 22A'–B' closely received in the steel housing 12' against a lip 24' thereof and an impeller 26' in a pump chamber 28' defined between the plastic housings. An inlet 30' to the pump chamber 28' is defined inside a cylindrical boss 32' on the plastic housing 22A'. A discharge, not shown, from the pump chamber 28' is defined in the plastic housing 22B'.

Figure 5:
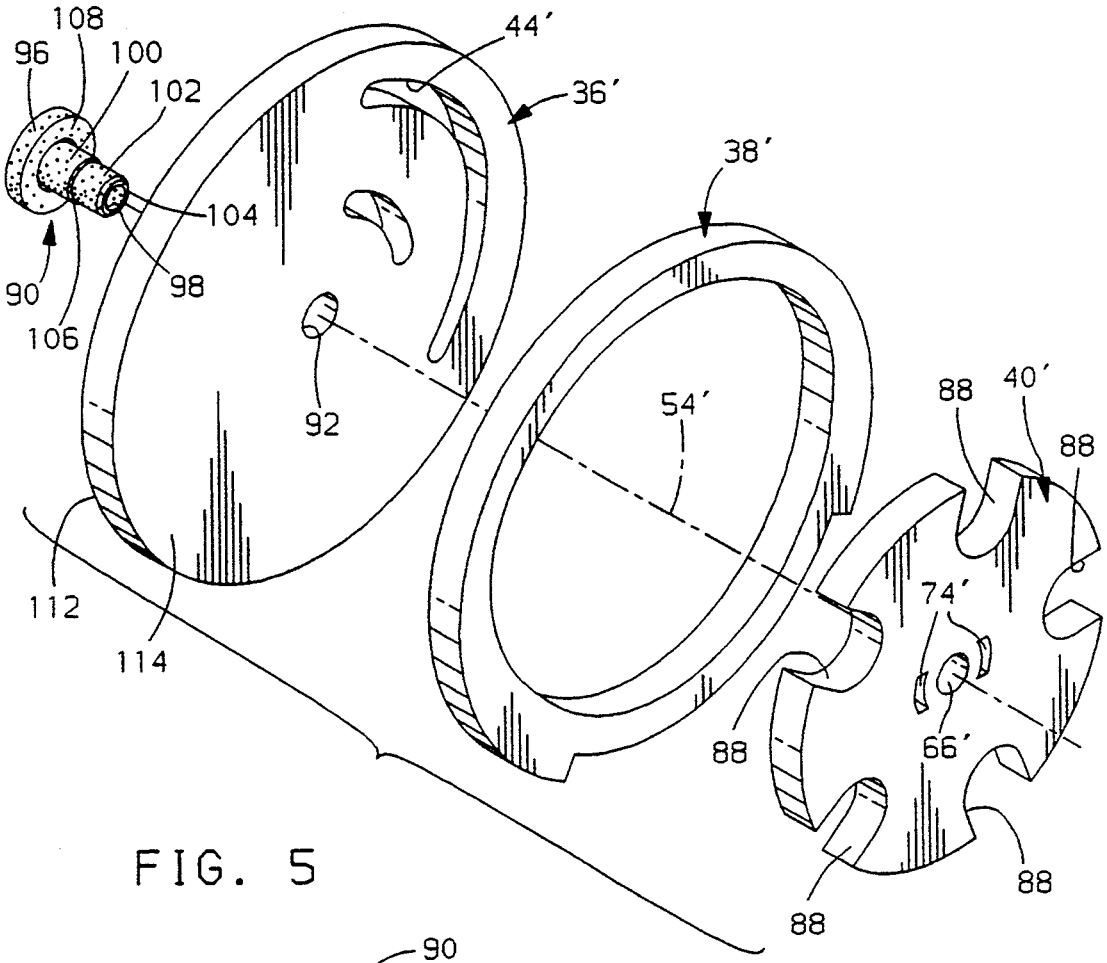
FIG. 5 is an enlarged perspective view of a portion of FIG. 3.

The roller vane pump 16' includes a flat, disc-shaped first or inner steel side plate 34' closely received in the steel housing 12' nearest the motor 18', a flat, disc-shaped second or outer steel side plate 36' closely received in the steel housing 12' furthest from the motor 18', a cam ring 38' between the side plates 34', 36', a rotor 40' inside the cam ring, and a plurality of rollers 42' in corresponding ones of a plurality of pockets 88, FIG. 5, in the rotor. An inlet port 44' of the roller vane pump in the outer side plate 36' communicates with the discharge of the turbine pump 14'. Fuel is discharged into the center of the housing 12' around the motor 18' through a discharge port 46' of the roller vane pump in the inner side plate 34'. High pressure fuel is discharged from the housing 12' through a tubular boss 48' on the end housing 20'.

A cylindrical commutator end 50' of an armature shaft 52' of the electric motor is supported for rotation about a centerline 54' of the tubular steel housing 12' in a journal defined by a bore 56' in the end housing 20'. A cylindrical pump end 58' of the armature shaft is supported for rotation about the centerline 54' by a T-shaped sleeve bearing 90 in a plain cylindrical bore 92 in the outer side plate 36'. The pump end of the armature shaft is flatted to define a drive tang 76' which engages a correspondingly shaped bore in the impeller 26' of the turbine pump.

Figure 4:
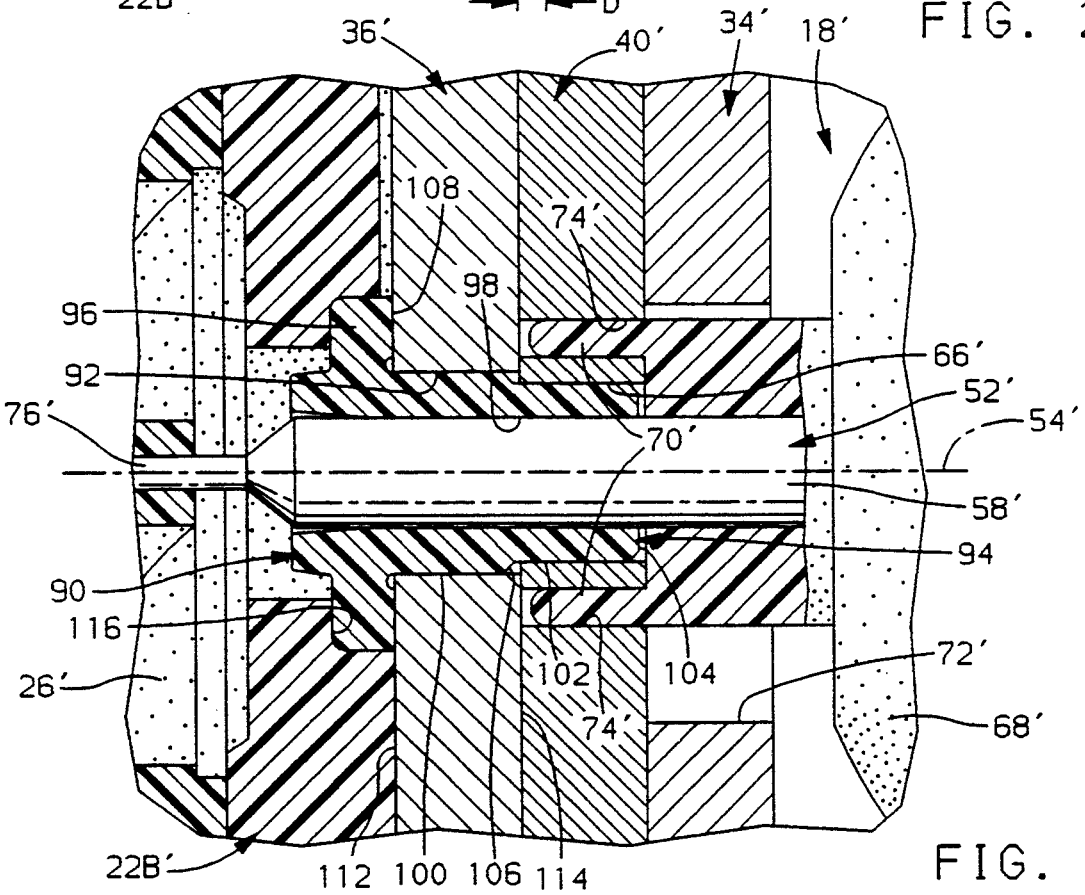
FIG. 4 is an enlarged view of a portion of FIG. 3.
Figure 3:
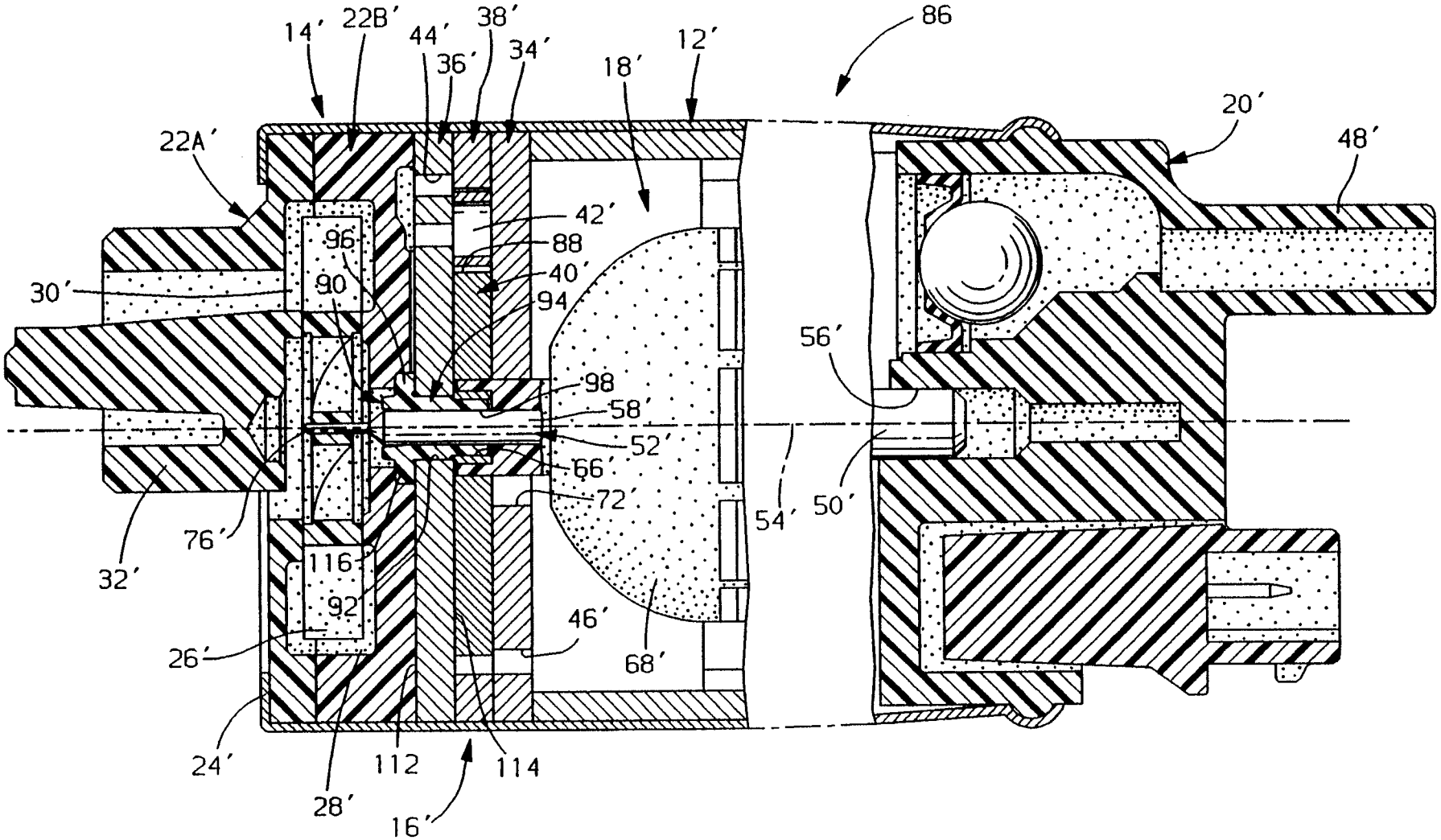
FIG. 3 is a fragmentary, sectional view taken along the longitudinal centerplane of a motor vehicle fuel pump according to this invention.
Figure 6:
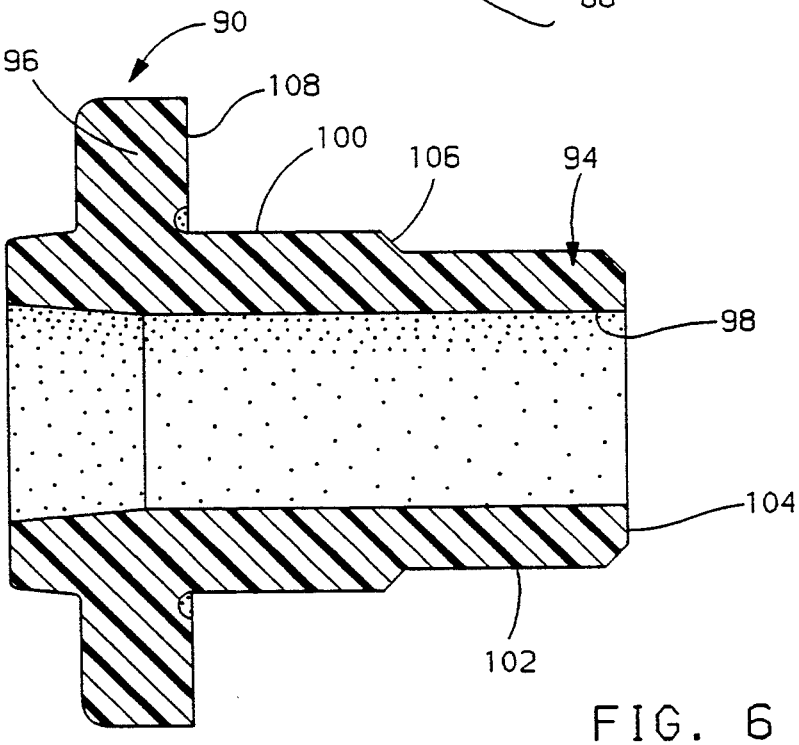
FIG. 6 is a sectional view of a sleeve bearing of a motor vehicle fuel pump according to this invention.

As seen best in FIGS. 4–6, the sleeve bearing 90 has a tubular body 94 with an annular lip 96 at one end thereof. The tubular body has a shaft bore 98 therethrough and a stepped outer wall including a large diameter part 100 adjacent the lip 96, a small diameter part 102 between the large diameter part 100 and a distal end 104 of the tubular body, and a frustoconical step 106 between the large diameter and small diameter parts 100, 102. The side of the lip 96 facing the distal end 104 of the tubular body 94 defines an annular seat 108 in a plane perpendicular to the tubular body, FIG. 6.

The diameter of the large diameter part 100 is calculated to achieve an interference fit with the plain cylindrical bore 92 in the outer side plate 36'. The length of the large diameter part 100 is calculated to substantially span the thickness of the outer side plate 36'. The diameter of the small diameter part 102 is calculated to achieve a close running fit with a cylindrical centerbore 66' in the rotor 40' of the roller vane pump 16'.

The sleeve bearing 90 is installed on the outer side plate 36' by inserting the distal end 104 of the tubular body 94 in the plain bore 92 from outboard of a flat outside surface 112 of the outer side plate. The small diameter part 102 of the outer wall passes freely through the plain bore. The frustoconical step 106 on the outer wall centers the tubular body 94 in the bore 92 as the large diameter part 100 of the outer wall is force fitted in the plain bore until the annular seat 108 engages flush against the outside surface 112 of the outer side plate.

With the annular seat 108 flush against the outside surface 112, the small diameter part 102 of the sleeve bearing protrudes a predetermined distance beyond the inside surface 114 of the outer side plate and defines a stationary journal on the latter for the rotor 40' of the roller vane pump. The pump end 58' of the armature shaft 52' is received in the shaft bore 98 in the tubular body 94 with a close running fit whereby the pump end is supported on the outer side plate 36' for rotation about the centerline 54'. A plastic driver 68' molded on the armature shaft 52' has a pair of lugs 70' protruding through an access opening 72' in the inner side plate 34' into corresponding ones of a pair of oversize sockets 74' in the rotor 40'. When the motor 18' is on, the lugs 70' and the tang 76', respectively, rotate the rotor 40' and the impeller 26' as a unit with the armature shaft.

The dimension by which the distal end 104 of the tubular body of the sleeve bearing protrudes beyond the inside surface 114 of the outer side plate is calculated to not exceed the thickness of the rotor 40'. The lip 96 on the sleeve bearing 90, flush against the outside surface 112 of the outer side plate 36', is captured in a relief 116 in the plastic housing 22B'. When the electric motor 18' is on, armature shaft thrust parallel to the centerline 54' toward the pumps 14', 16' is reacted against rotor 40' and then to the outer side plate 36'.

The annular lip 96 on the sleeve bearing 90 is an important feature of this invention because the relatively broad area of engagement of the seat 108 thereof on the outer side plate 36' operates to positively and automatically locate the tubular body of the sleeve bearing perpendicular to the plane of the outer side plate 36' when the seat is pressed flush against the outside surface 112. Such perpendicularity assures maximum alignment of the shaft bore 98 with the cylindrical pump end 58' of the armature shaft.

The stepped outer wall on the sleeve bearing 90 is also an important feature of this invention. The frustoconical step 106 on the outer wall affords a pilot for facilitating force fit of the large diameter part 100 in the plain bore 92. Further, engagement of the large diameter part 100 across substantially the full length of the plain bore 92 in the outer side plate 36' cooperates with the contact area of the annular seat 108 on the outside surface 112 in maximizing resistance of the sleeve bearing to tipping in the plain bore 92 relative to the centerline 54'.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. A motor vehicle fuel pump comprising:

a tubular housing having a longitudinal centerline;

an electric motor in said tubular housing including an armature shaft having a cylindrical pump end;

a roller vane positive displacement pump in said tubular housing including a flat inner side plate nearest to said electric motor having an access opening therein surrounding said pump end of said armature shaft, a flat outer side plate furthest from said electric motor having a plain bore therein surrounding said pump end of said armature shaft and separated therefrom by a first annular clearance, and a rotor between said inner and said outer side plates having a centerbore therein around said pump end of said armature shaft separated therefrom by a second annular clearance; and a T-shaped sleeve bearing supporting said pump end of said armature shaft on said outer side plate for rotation about said longitudinal centerline of said tubular housing including a tubular body having a shaft bore therethrough defining a bearing for said pump end of said armature shaft, a stepped outer wall on said tubular body including a large diameter part in said first annular clearance force fitted in said plain bore, and a small diameter part in said second annular clearance spanning the thickness of said rotor so that said rotor is supported on said outer side plate for rotation about said longitudinal centerline of said tubular housing, and a lip on said tubular body at an end of said large diameter part of said outer wall thereof having a side defining an annular seat in a plane perpendicular to said tubular body engaged flush against an outside surface of said outer side plate.

2. The motor vehicle fuel pump recited in claim 1 further including:

means on said T-shaped sleeve bearing defining a frustoconical shoulder between said large diameter part of said outer wall and said small diameter part of said outer wall operative to center said tubular body in said plain bore when said large diameter part is force fitted in said plain bore.

3. The motor vehicle fuel pump recited in claim 2 further including:

a pair of sockets in said rotor of said roller vane pump, and a driver on said armature shaft having a pair of lugs protruding through said access opening in said inner side plate into corresponding ones of said sockets in said rotor whereby said rotor is rotated as a unit with said armature shaft.

* * * * *